United States Patent [19]

Pearson

[11] Patent Number: 4,737,308

[45] Date of Patent: Apr. 12, 1988

[54] CLEANING AGENT

[76] Inventor: Elmer O. Pearson, 5907 California Ave. SW., Seattle, Wash. 98136

[21] Appl. No.: 599,584

[22] Filed: Apr. 12, 1984

Related U.S. Application Data

[63] Continuation-in-part of Ser. No. 452,628, Mar. 19, 1974, abandoned.

[51] Int. Cl.[4] ..... C11D 3/22; C11D 7/12

[52] U.S. Cl. ..... 252/174.14; 252/89.1; 252/135; 252/156; 252/174.17; 252/DIG. 2

[58] Field of Search ..... 252/89.1, 135, 156, 252/174.14, 174.17, DIG. 2

[56] References Cited

U.S. PATENT DOCUMENTS

| | | | |
|---|---|---|---|
| 2,678,303 | 5/1954 | Bonewitz et al. | 252/156 |
| 2,940,877 | 6/1960 | Jaffee et al. | 134/38 |
| 3,062,878 | 11/1962 | Karabinos et al. | 252/174.17 |
| 3,074,927 | 1/1963 | Saltman et al. | 252/174.17 |
| 3,272,752 | 9/1966 | Hartlapp | 252/135 |
| 3,629,121 | 12/1971 | Eldib | 252/79 |
| 3,686,124 | 8/1972 | Lyness et al. | 252/174.18 |
| 3,701,735 | 10/1972 | Finck | 252/99 |
| 3,714,063 | 1/1973 | Salmone | 252/312 |
| 3,846,325 | 11/1974 | Flynn | 252/99 |
| 3,957,695 | 5/1976 | Davies et al. | 252/181 |
| 4,147,652 | 4/1979 | Kaniecki | 252/156 |

FOREIGN PATENT DOCUMENTS

| | | |
|---|---|---|
| 667815 | 7/1963 | Canada . |
| 1065730 | 11/1979 | Canada . |
| 198598 | 11/1983 | Japan . |

OTHER PUBLICATIONS

Uses & Applications of Chemicals & Related Materials; vol. 1, p. 142, T. C. Gregory, Sep. 9, 1935, vol. 2, p. 165, T. C. Gregory (1944).

Hackh's Chemical Dictionary, 4th Ed., 1969 p. 644, McGraw-Hill Book Co.

The American Heritage Dictionary, p. 1216 2nd College Ed., Houghton Miflin Co., Boston.

*Primary Examiner*—Prince E. Willis

*Attorney, Agent, or Firm*—T. W. Secrest

[57] ABSTRACT

This invention is directed to a cleaning agent which can be used for cleaning dishes, tableware such as knives, forks and spoons and the like, and also glassware in an automatic dishwashing machine or by hand and manually in an aqueous solution. Also, this cleaning agent can be used for cleaning cloth, fabric and clothes in an automatic washing machine or by hand or manually in an aqueous solution. The cleaning agent is free of phosphorous and a phosphorous compound. The cleaning agent comprising a complex of sodium and dextrin, sodium chloride, sodium carbonate and sodium hydroxide. The components are mixed in a concrete mixer or a ball mill to pass through a 40 mesh screen, and, preferably, not pass through a 60 mesh screen. There is sodium hydroxide and there is dextrin. The sodium hydroxide and the dextrin react to form a complex of sodium and dextrin. Also, the cleaning agent can comprise a surfactant and a anti-pollution agent.

22 Claims, No Drawings

CLEANING AGENT

This patent application is a continuation-in-part of co-pending patent application Ser. No. 452,628, filing date of Mar. 19, 1974 now abandoned. There was filed in Canada a corresponding application to said Ser. No. 452,628 a patent application on Mar. 12, 1975, claiming the United States priority date of Mar. 19, 1974 for Ser. No. 452,628, having Canadian patent application No. 221,893 which matured into a Canadian Pat. No. 1,065,730, with an issuing date of Nov. 6, 1979 and entitled CLEANING AGENT.

THE BACKGROUND OF THE INVENTION

A cleaning agent is often specific to a certain area of cleaning. One area of cleaning may be for a dishwashing machine. Another area of cleaning may be for clothes and cloth such as cleaning with a washing machine for laundry.

In a dishwashing machine it is necessary to remove the food from the dishes. As is well known, food will dry to dishes and tableware. Food which is dried onto the dishes and tableware is often difficult to remove. In certain instances a person is in a hurry and will not have the time to wash the dishes immediately after eating. The person may allow the food to dry on the dishes for three or four days. For example, a person may eat breakfast and have eggs and the yolk of the eggs may dry on the dishes and tableware. The removal of dried egg yolk on dishes and tableware is difficult. In other instances the person may have spread peanut butter on bread or toast or muffins and allowed some of the peanut butter to stick to the tableware and also to a plate. The removal of the peanut butter from the tableware and the plate is difficult. A dishwashing compound for use in a mechanical dishwasher or automatic dishwasher is designed to be used at a temperature above 140° F. and also contains a high phosphorus content, usually, as trisodium phosphate. The high temperature of above 140° F. makes it possible for the cleaning agent to work more rapidly on the food on the plate and on the tableware. The trisodium phosphate is a well-known and good cleaning agent. In an aqueous solution at a high temperature the trisodium phosphate does a good job on cleaning the dishes and the tableware. Also, in a dishwashing compound for use in an automatic dishwasher it is necessary to prevent the deposition of a particulate on the glassware or to prevent spots on the glassware. The deposition of a small particulate on tableware and also on dishes does not readily show and most people will not observe the deposition of small particulate matter on these objects. However, with glassware, the deposition of particulate on the glass does show. As a result, it is necessary that the dishwashing compound used in an automatic dishwashing machine be such as to prevent the deposition of particulates on the glassware.

A cleaning agent for use in automatic washing machines for cleaning clothes must remove the contaminants from the cloth and also prevent the deposition of particulates on the cloth. The temperature at which the water is in an automatic washing machine can be adjusted depending upon the material being washed. The cleaning agents used in an automatic washing machine quite often comprise a phosphate such as trisodium phosphate. The trisodium phosphate, again, is a good cleaning agent and will remove impurities on cloth.

Further, it is necessary to prevent the deposition of particulate on the cloth after the impurities have been removed from the cloth.

In the preparation of this patent application, I went to the supermarket and bought three popular types of dishwashing compound for use with an automatic dishwasher and also purchased three detergents for use in an automatic washing machine.

On the lable of the first dishwashing compound there was stated that this dishwashing compound: "contains ingredients to soften water (complex sodium phosphates), to prevent the water spotting of glassware (chlorinated trisodium phosphate and nonionic surfactant) and to protect china surfaces and washer parts (sodium silicate), plus small quantities of suds control agent, colorant and perfume."and there was also stated this dishwashing compound "formula averages 12.9% phosphorus, in the form of phosphates, which is equivalent to 3.1 grams per 2 tablespoons use level."

A second dishwashing compound for use in an automatic dishwasher stated on the label: "contains water softening agent, complex sodium phosphate; corrosion inhibitor, sodium silicate; for cleaning and prevention of water spots on glassware, chlorinated phosphate and nonionic surfactant; and suds regulating agent." There is also stated on the label that this dishwashing compound "contains 12.9% phosphorus in the form of phosphates which is equivalent to 3.0 grams per use assuming 2 tablespoons per load."

A third dishwashing compound for use in an automatic dishwashing machine did not state what the ingredients were, but did state on the label this dishwashing compound "averages not more than 8.7% phosphorous, in the form of phosphates, which is equivalent to 2.4 grams per 2 tablespoons use level."

From the foregoing it is seen that the three dishwashing compounds contain phosphorus as phosphates. In the foregoing part of this patent application, it was stated that tridsodium phosphate is a good cleaning agent and is often used in cleaning agents and in detergents.

All three of the foregoing dishwashing compounds recommended that the temperature be at least 140° F. Again, a high temperature for the water means that there will be a high activity rate for the cleaning agent on the plates, tableware and glass.

With respect to the detergent for use in an automatic washing machine the first detergent that I purchased had on the label the following: "Cleaning agents (anionic surfactants), water softeners (complex sodium phosphates, sodium carbonate), color-safe oxygen bleach (sodium perborate) processing aids (sodium sulfate), washer protection agents, fabric whitener, colorant, perfume and an agent to prevent deposition." Also, on the label there was stated this detergent "formula averages 7.2% phosphorus, in the form of phosphates, which is equivalent to 5.5 grams per ¾ cup use level."

The second detergent for use in automatic washing machines stated on the label: "contains surfactant, linear alkylate sulfonate; water conditioning agents, complex sodium phosphates and sodium carbonate; processing aid, sodium sulfate; corrosion inhibitor, sodium silicate; moisture; soil suspending agent; fabric brightener and perfume." Also, there was stated on the label that this detergent "formula averages 6.1% phosphorus in the form of phosphates, which is equivalent to 4.7 grams per 1 cup use level."

The third detergent for use in automatic washing machines stated on the label: "Cleaning agents (anionic surfactants), water softeners (complex sodium phosphates, sodium carbonate), processing aids (sodium sulfate), washer protection agents, fabric whitener, perfume and an agent to prevent deposition."Further, it was stated on the label this detergent "formula averages 8.2% phosphorus, in the form of phosphates, which is equivalent to 6.3 grams per ¾ cup use level."

The three above detergents or cleaning agents for use in automatic washing machines for clothes and cloth all contain phosphorus as phosphates and as sodium phosphates. Again, trisodium phosphate is a good cleaning agent and is often used as a supplement to other components in a cleaning agent.

The use of phosphorus compounds, from an ecological standpoint, is not desirable as phosphorus compounds are considered to be pollutants. A source of pollution in water and aqueous solutions, such as a lake, ocean, river and the like, is a cleaning agent comprising phosphates such as a complex sodium phosphate or a trisodium phosphate.

Within the last few years there has been a tendency and desire to try to use cleaning agents that do not contain a phosphate such as trisodium phosphate. This has been difficult as trisodium phosphate is, generally, inexpensive and is a fine cleaning agent. The development of cleaning agents which do not contain a phosphate has been difficult.

From the foregoing it is seen that the phosphorus content expressed as a phosphate is higher or more concentrated for an automatic dishwashing machine for removing food from plates and tableware as compared with a cleaning agent used in a laundry in an automatic washing machine for removing impurities from cloth. The reason for this is that the removal of food from tableware and plates is more difficult than the removal of an impurity from a cloth. The higher concentration of the trisodium phosphate as a cleaning agent for use in an automatic dishwasher as compared for use in an automatic washing machine makes it possible to remove the food from the plates and tableware. It is questionable if one of the above-identified cleaning agents for use in an automatic washing machine would be appropriate and would function in an automatic dishwashing machine. The concentration of the trisodium phosphate in the cleaning agent for an automatic washing machine is too low for use in an automatic dishwasher. The cleaning agents used in automatic washing machines will not clean the food from plates and the tableware in an automatic dishwashing machine. To try to insure the removal of food from plates and tableware in an automatic dishwashing machine the concentration of the phosphates such as trisodium phosphate must be relatively high. The relatively high concentration of the trisodium phosphate or the complex sodium phosphate means that the pH of the aqueous solution in the automatic dishwasher would be in the range of about 11. With the cleaning agent for use in an automatic washing machine the pH will not reach to 11 in an automatic dishwasher. The pH of a cleaning agent for use in an automatic washing machine, when used in an automatic dishwasher would be less than 11 because the aqueous solution is being continuously discharged as compared with the washing process of an automatic washing machine being a batch process during part of the cleaning for the washing cylce.

With this background of cleaning agents used in automatic dishwashing machines and also automatic washing machines, I have developed a cleaning agent which is free of a phosphorus compound such as a sodium phosphate or a complex sodium phosphate or trisodium phosphate and also can be used in an automatic dishwashing machine and in an automatic washing machine for clothes.

A BRIEF DESCRIPTION OF THE INVENTION

This invention is directed to a cleaning agent which does not use a phosphorus compound and does not use a phosphate such as trisodium phosphate.

The invention is directed to a cleaning compound which can be readily prepared in commercially available low-cost equipment. The invention is designed to prepare a cleaning agent which results in a high pH or an alkaline pH for cleaning food and particulate matter from plates, tableware and glass in an automatic dishwashing machine. Also, the cleaning agent can be used for cleaning cloth in an automatic washing machine.

The components comprise a low cost carrier for other chemicals which dissolve in water and produce an alkaline pH or a high pH. There is a combination of raw materials which upon being processed and mixed together produce a salt of a strong base and a weak acid. In the aqueous solution the salt of the strong base and the weak acid hydrolizes to give a high pH.

A DETAILED DESCRIPTION OF THE INVENTION

The cleaning agent of this invention is free of phosphorus. A phosphorus compound is not used in this cleaning agent. The cleaning agent, in an aqueous solution, will have a relatively high pH in the range of 10 to 12 and can be made from readily available materials.

There is used sodium hydroxide and dextrin, to form a complex of sodium and dextrin. In an aqueous solution the complex of sodium and dextrin raises the pH of the aqueous solution.

There is sodium carbonate, which, in an aqueous solution, raises the pH of the aqueous solution.

There is a surfactant, a surface-active agent, that changes the properties of the liquid to which it is added. The surfactant lowers the water's surface tension enabling faster wetting of the tableware and silverware and glassware to be cleaned and also the fabric being washed. The soil and also the food can be more readily loosened and removed with the aid of a surfactant.

There is an anti-deposition agent, anti-soil redeposition agent, that is used to help prevent dirt and soil and food from resettling on tableware, dishware, glassware and fabric after these items have been removed after the washing process.

There is sodium chloride, which is a neutral salt or a neutral material.

The components of the cleaning agent are mixed in a concrete mixer. The concrete mixer is of a four cubic foot capacity. The ingredients in the range of about 150 to 170 pounds are loaded into the concrete mixer. The concrete mixer is essentially a ball mill as 100 one inch black iron sleeved couplings are added to the concrete mixer and to the components of the cleaning agent. The one inch black iron sleeved couplings are plugged at each end by pipe plugs. For the 100 one inch black iron sleeved couplings there are 200 pipe plugs. The one inch black iron sleeved couplings are, essentially, a modified ball and with the rotation of the concrete mixer the components of the cleaning agent and the one inch black iron sleeved couplings mix and fall against each other and the cleaning agent comes out about a 40 mesh size. The cleaning agent will pass through a 40 mesh screen and, preferably, will not through a 60 mesh screen. However, from a practical view point, it does not make a great deal of difference if the cleaning agent can pass through a 60 mesh screen.

In the following dissertation there is presented 15 examples of the cleaning agent.

EXAMPLE I

| MIX | COMPONENT | WEIGHT (POUNDS) | PERCENT BY WEIGHT |
|---|---|---|---|
| 1 | Sodium Chloride | 40.0 | 25.16 |
| 2 | Sodium Hydroxide (granular) | 1.0 | .63 |
| 3 | Sodium Chloride | 80.0 | 50.32 |
| Mix the above for about ten (10) minutes to form first mixture. | | | |
| 4 | Dextrin | 4.0 | 2.51 |
| 5 | Sodium Carbonate (heavy) | 25.0 | 15.76 |
| 6 | Surfactant | 1.0 | .63 |
| 7 | Anti-deposition Agent | 8.0 | 5.03 |
| | | 159 Pounds | |
| Mix the above seven components for about fifteen (15) minutes to form the solid cleaning agent. | | | |

The cleaning agent was in the 40 mesh to 60 mesh solid size. One gram of the cleaning agent in 100 cc of water resulted in a pH of 11.

One hundred grams of the cleaning agent in 20 gallons of water resulted in a pH of about 7. The solution of 100 grams of cleaning agent in 20 gallons of water was tested by placing 20 cc of the aqueous solution in a 50 cc graduate and shaking 100 times. There resulted 5 cc of foam.

On glasses such as drinking glasses and tableware glasses, there were no spots or zero spots resulting from washing in the dishwasher with the cleaning agent. Also, the glasses were clear after washing in the dishwashing machine.

The sodium chloride, sodium hydroxide and sodium chloride were mixed for about ten minutes to form a first mixture. Then there was mixed with the first mixture dextrin, sodium carbonate, surfactant and an anti-deposition agent to form the solid cleaning agent. The majority of the solid cleaning agent would pass through a forty mesh screen but not pass through a sixty mesh screen.

EXAMPLE II

| MIX | COMPONENT | WEIGHT (POUNDS) | PERCENT BY WEIGHT |
|---|---|---|---|
| 1 | Sodium Chloride | 30.0 | 18.63 |
| 2 | Sodium Hydroxide (granular) | 3.0 | 1.86 |
| 3 | Sodium Chloride | 80.0 | 49.68 |
| 4 | Surfactant | 1.0 | .62 |
| 5 | Anti-deposition Agent | 5.0 | 3.10 |
| Mix three (3) to five (5) minutes to form first mixture. | | | |
| 6 | Sodium Carbonate (light soda ash) | 30.0 | 18.63 |
| 7 | Dextrin | 12.0 | 7.45 |
| | | 161.0 Pounds | |

-continued

| MIX | COMPONENT | WEIGHT (POUNDS) | PERCENT BY WEIGHT |
|---|---|---|---|
| Mix for ten (10) minutes to form the solid cleaning agent. | | | |

The cleaning agent was tested in an aqueous solution by placing one gram of the cleaning agent in 100 cc of water to have a resulting pH of 11 in the aqueous solution.

With the dissolving of 100 grams of the cleaning agent in 20 gallons of water, the resulting aqueous solution had a pH of about 8.5. The resulting aqueous solution was tested by taking 20 cc and shaking in a 50 cc graduate for 100 shakes. The foam measured 4 cc.

With the washing of dishware and glassware in an automatic washing machine there were no spots on the resulting glassware and the glassware was clear.

The sodium chloride, sodium hydroxide, sodium chloride, surfactant and an anti-deposition agent were mixed to form a first mixture. Then, the first mixture was mixed with sodium carbonate and dextrin to form the solid cleaning agent. The majority of the solid cleaning agent would pass through a forty mesh screen and not pass through a sixty mesh screen.

EXAMPLE III

| MIX | COMPONENT | WEIGHT (POUNDS) | PERCENT BY WEIGHT |
|---|---|---|---|
| 1 | Sodium Chloride | 30.0 | 18.75 |
| 2 | Sodium Hydroxide (granular) | 4.0 | 2.50 |
| 3 | Sodium Chloride | 80.0 | 50.00 |
| 4 | Surfactant | 1.0 | .63 |
| 5 | Anti-deposition Agent | 4.0 | 2.50 |
| Mix three (3) to five (5) minutes to form a first mixture. | | | |
| 6 | Sodium Carbonate (light soda ash) | 25.0 | 15.63 |
| 7 | Dextrin | 16.0 | 10.00 |
| | | 160.0 Pounds | |
| Mix ten (10) minutes to form the solid cleaning agent. | | | |

The cleaning agent was tested by dissolving one gram in 100 cc of water to form an aqueous solution having a pH of 11.

The dissolving of 100 grams in 20 gallons of water resulted in an aqueous solution with a pH of 9. Twenty cc of this aqueous solution was placed in a 50 cc graduate and shaken 100 times to produce 5 cc of foam.

In an automatic dishwashing machine the tableware, plates, silverware and glasses were washed. The glassware came out clear with no spots or zero percent spots.

The size of the cleaning agent was in the range of 40 mesh to 60 mesh.

The sodium chloride, sodium hydroxide, sodium chloride, surfactant and an anti-deposition agent were mixed to form a first mixture. Then, the first mixture was mixed with sodium carbonate and dextrin to form the solid cleaning agent. The majority of the solid cleaning agent would pass through a 40 mesh screen but not pass through a 60 mesh screen.

EXAMPLE IV

| MIX | COMPONENT | WEIGHT (POUNDS) | PERCENT BY WEIGHT |
|---|---|---|---|
| 1 | Sodium Chloride | 40.0 | 25.80 |
| 2 | Sodium Hydroxide | 1.0 | .65 |
| 3 | Dextrin | 4.0 | 2.58 |
| 4 | Sodium Chloride | 80.0 | 51.60 |
| 5 | Surfactant | 1.0 | .65 |
| 6 | Anti-deposition | 1.4 | 2.58 |
| | Mix ten (10) minutes to form a first mixture. | | |
| 7 | Sodium Carbonate | 25.0 | 16.13 |
| | | 155.0 Pounds | |
| | Mix fifteen (15) minutes to form the solid cleaning agent. | | |

The sodium chloride, sodium hydroxide, sodium chloride, surfactant and anti-deposition agent were mixed to form a first mixture. Then the first mixture was mixed with the sodium carbonate to form the solid cleaning agent. The solid cleaning agent was of a particle size that a majority of it would pass through a 40 mesh sreen and not pass through a 60 mesh screen.

One gram of the solid cleaning agent was mixed with 100 cc of water to produce an aqueous solution with a pH of about 10.5.

Then, 100 grams of the solid cleaning- agent was mixed with 20 gallons of water to form an aqueous solution having a pH of about 7. Twenty cc of this aqueous solution was placed in a 50 cc graduate and agitated by shaking 100 times. There resulted 1 cc of foam in the 50 cc graduate. Then, dishes, eating utensils and glassware were washed in an automatic dishwasher with the solid cleaning agent. The dishes and eating utensils were clean. The glassware was clear and without spots.

EXAMPLE V

| MIX | COMPONENT | WEIGHT (POUNDS) | PERCENT BY WEIGHT |
|---|---|---|---|
| 1 | Sodium Chloride | 80.0 | 48.48 |
| 2 | Sodium Hydroxide (granular) | 3.0 | 1.81 |
| | Mix five (5) minutes to form a first mixture. | | |
| 3 | Sodium Carbonate (light soda ash) | 70.0 | 42.42 |
| | Mix five (5) minutes to form a second mixture. | | |
| 4 | Dextrin | 4.0 | 2.42 |
| | Mix five (5) minutes to form a third mixture. | | |
| 5 | Surfactant | 1.0 | .61 |
| 6 | Anti-deposition | 7.0 | 4.24 |
| | Agent | 165.0 Pounds | |
| | Mix ten (10) minutes to form the solid cleaning agent. | | |

The cleaning agent had free flowing crystals of a mesh size in the range of 40 mesh to 60 mesh.

One gram of the cleaning agent was placed in 100 cc of water to form a resulting aqueous solution having a pH of about 11.

Then, 100 grams of the cleaning agent was placed in 20 gallons of water with the resulting aqueous solution having a pH of about 9. Twenty cc of this resulting aqueous solution was placed in a 50 cc graduate and agitated by shaking 100 times. There resulted 3 cc of foam in the graduate on top of the aqueous cleaning solution.

In the automatic dishwashing machine the tableware and dishes and eating utensils were clean and the glassware did not have any spots and was clear.

The sodium chloride and sodium hydroxide were mixed to form a first mixture. Then, the first mixture was mixed with sodium carbonate to form a second mixture. The second mixture was mixed with dextrin to form a third mixture. The third mixture was mixed with the surfactant and an anti-deposition agent to form the solid cleaning agent. The solid cleaning agent was of such size that a majority of it would pass through a 40 mesh screen but not pass through a 60 mesh screen.

EXAMPLE VI

| MIX | COMPONENT | WEIGHT (POUNDS) | PERCENT BY WEIGHT |
|---|---|---|---|
| 1 | Sodium Chloride | 40.0 | 23.64 |
| 2 | Sodium Hydroxide (granular) | 6.0 | 3.55 |
| 3 | Sodium Chloride | 80.0 | 47.29 |
| | Mix three (3) to five (5) minutes to form a first mixture. | | |
| 4 | Sodium Carbonate (light soda ash) | 25.0 | 14.78 |
| | Mix five (5) minutes to form a second mixture. | | |
| 5 | Dextrin | 8.0 | 4.72 |
| | Mix five (5) minutes to form a third mixture. | | |
| 6 | Surfactant | 1.0 | .59 |
| 7 | Anti-deposition | 9.0 | 5.32 |
| | Agent | 169.0 Pounds | |
| | Mix five minutes to form the solid cleaning agent. | | |

The cleaning agent was a solid having free flowing crystals in the size of about 40 mesh to 60 mesh.

One gram of a solid cleaning agent was placed in 100 cc of water to form an aqueous solution having a resulting pH of about 11.

One hundred grams of the solid cleaning agent was placed in 20 gallons of water to form an aqueous solution having a pH of about 9. Twenty cc of this aqueous solution was placed in a 50 cc graduate and agitated by shaking 100 times. There resulted 5 cc of foam on top of the aqueous cleaning solution in the 50 cc graduate.

In the automatic dishwashing machine, the tableware such as dishes and eating utensils were clean and the glassware did not have spots and was clear.

The sodium chloride, sodium hydroxide and sodium chloride were mixed to form a first mixture. The first mixture was mixed with sodium carbonate to form a second mixture. The second mixture was mixed with dextrin to form a third mixture. The third mixture was mixed with a surfactant and an anti-deposition agent to form a solid cleaning agent. The solid cleaning agent was of such a size that a majority of it would pass through a 40 mesh screen but not pass through a 60 mesh screen.

EXAMPLE VII

| MIX | COMPONENT | WEIGHT (POUNDS) | PERCENT BY WEIGHT |
|---|---|---|---|
| 1 | Sodium Chloride | 40.0 | 24.40 |
| 2 | Sodium Hydroxide (granular) | 3.0 | 1.83 |
| 3 | Dextrin | 10.0 | 6.10 |
| 4 | Sodium Carbonate (soda ash) | 100.0 | 61.00 |
| 5 | Surfactant | 4.0 | 2.44 |
| 6 | Anti-deposition | 7.0 | 4.27 |

-continued

| MIX | COMPONENT | WEIGHT (POUNDS) | PERCENT BY WEIGHT |
|---|---|---|---|
| | | 164.0 Pounds | |
| | Mix twenty-five (25) minutes to form the solid cleaning agent. | | |

The cleaning agent was a solid of a size in the 40 mesh to the 60 mesh range.

One gram of the solid cleaning agent was placed in 100 cc of water to form an aqueous solution having a pH of about 11.

One hundred grams of the cleaning agent was placed in 20 gallons of water to form a resulting aqueous solution having a pH of about 9. Twenty cc of this resulting aqueous solution was placed in a 50 cc graduate and agitated by shaking 100 times. There resulted 5 cc of foam on top of the resulting aqueous cleaning solution in the 50 cc graduate.

Dishes and eating utensils and glassware were washed in an automatic dishwashing machine with the aid of this cleaning agent and the dishes and eating utensils were clean and the glassware was clear and did not have any spots.

The sodium chloride, sodium hydroxide, dextrin, sodium carbonate, surfactant and anti-deposition agent were mixed to form the solid cleaning agent. The solid cleaning agent was of such a size that a majority of it would pass through a 40 mesh screen but would not pass through a 60 mesh screen.

EXAMPLE VIII

| MIX | COMPONENT | WEIGHT (POUNDS) | PERCENT BY WEIGHT |
|---|---|---|---|
| 1 | Sodium Chloride | 40.0 | 26.12 |
| 2 | Sodium Hydroxide (granular) | 3.0 | 1.96 |
| | Mix three (3) to five (5) minutes to form a first mixture. | | |
| 3 | Sodium Carbonate (heavy soda ash) | 100.0 | 65.30 |
| | Mix five (5) minutes to form a second mixture. | | |
| 4 | Dextrin | 4.0 | 2.61 |
| | Mix five (5) minutes to form a third mixture. | | |
| 5 | Surfactant | 1.0 | .65 |
| 6 | Anti-deposition | 5.0 | 3.27 |
| | Agent | 153.0 Pounds | |
| | Mix ten (10) minutes to form the solid cleaning agent. | | |

The solid cleaning agent was free-flowing and the size ranging from about 40 mesh to about 60 mesh.

One gram of the solid cleaning agent was placed in 100 cc of water to form an aqueous solution having a pH of about 11.

One hundred grams of the solid cleaning agent was placed in 20 gallons of water to form an aqueous cleaning solution of about 9. Twenty cc of the aqueous cleaning solution was placed in a 50 cc graduate and agitated by shaking 100 times. There resulted 4 cc of foam on top of the aqueous cleaning solution in the 50 cc graduate.

Dishware, eating utensils and glassware were washed with the solid cleaning agent in an automatic dishwashing machine and the glassware came out clear with no spots.

The sodium chloride and sodium hydroxide were mixed to form a first mixture. The first mixture was mixed with sodium carbonate to form a second mixture. The second mixture was mixed with dextrin to form a third mixture. The third mixture was mixed with a surfactant and a anti-deposition agent to form a solid cleaning agent. The solid cleaning agent was of such a size as to have a majority of it pass through a 40 mesh screen but would not pass through a 60 mesh screen.

EXAMPLE IX

| MIX | COMPONENT | WEIGHT (POUNDS) | PERCENT BY WEIGHT |
|---|---|---|---|
| 1 | Sodium Chloride | 40.0 | 24.08 |
| 2 | Sodium Hydroxide (granular) | 6.0 | 3.61 |
| 3 | Dextrin | 8.0 | 4.82 |
| | Mix fifteen (15) minutes to form a first mixture. | | |
| 4 | Sodium Carbonate (soda ash) | 25.0 | 15.05 |
| 5 | Sodium Chloride | 80.0 | 48.16 |
| 6 | Surfactant | 2.0 | 1.20 |
| 7 | Anti-deposition | 5.0 | 3.01 |
| | Agent | 166.0 Pounds | |
| | Mix fifteen (15) minutes to form the solid cleaning agent. | | |

The resulting solid cleaning agent was in the size range of 40 mesh to 60 mesh.

One gram of the solid cleaning agent was placed in 100 cc of water to form an aqueous solution having a pH of about 11.

Then, 100 grams of the solid cleaning agent was placed in 20 gallons of water to form a resulting aqueous solution with a pH of about 9. Twenty cc of the resulting cleaning solution was placed in a 50 cc graduate and agitated by shaking 100 times.

The result is 5 cc of foam on the resulting aqueous cleaning solution in the 50 cc graduate.

There was washed with the solid cleaning agent in an automatic dishwashing machine tableware, eating utensils and glassware. The tableware and eating utensils came out clean. The glassware came out clear and with no spots.

The sodium chloride, sodium hydrozide and dextrin were mixed together to form a first mixture. The first mixture was mixed with sodium carbonate, sodium chloride, a surfactant and a anti-deposition agent to form a solid cleaning agent. The solid cleaning agent was of such a size as the majority passed through a 40 mesh screen but would not pass through a 60 mesh screen.

EXAMPLE X

| MIX | COMPONENT | WEIGHT (POUND) | PERCENT BY WEIGHT |
|---|---|---|---|
| 1 | Sodium Chloride | 40.0 | 24.84 |
| 2 | Sodium Hydroxide (granular) | 6.0 | 3.73 |
| 3 | Dextrin | 12.0 | 7.45 |
| | Mix fifteen (15) minutes to form a first mixture. | | |
| 4 | Sodium Carbonate (soda ash) | 15.0 | 9.32 |
| 5 | Sodium Chloride | 80.0 | 49.69 |
| 6 | Surfactant | 2.0 | 1.24 |
| 7 | Anti-deposition | 6.0 | 3.73 |
| | Agent | 161.0 Pounds | |
| | Mix fifteen (15) minutes to form the solid cleaning agent. | | |

The resulted solid cleaning agent was, in the majority, of a mesh size in the range of 40 to 60 mesh One gram of the solid cleaning agent was placed in 100 cc of water to form an aqueous solution having a pH of about 11.

One hundred grams of the solid cleaning agent was placed in 20 gallons of water to form a resulting aqueous cleaning solution having a pH of about 9. Then, 20 cc of this resulting aqueous cleaning solution was placed in a 50 cc graduate and agitated by shaking 100 times. There resulted about 4 cc of foam on top of the resulting aqueous cleaning solution in the 50 cc graduate.

Tableware, eating utensils and glassware were washed in an automatic dishwashing machine with the solid cleaning agent. The tableware and eating utensils were clean. The glassware was clear with no spots.

The sodium chloride, sodium hydroxide and dextrin were mixed together to form a first mixture. The first mixture was sodium carbonate, sodium chloride, surfactant and an anti-deposition agent to form a solid cleaning agent. The solid cleaning agent was of such a size to have a majority pass through a 40 mesh screen but not pass through a 60 mesh screen.

EXAMPLE XI

| MIX | COMPONENT | WEIGHT (POUNDS) | PERCENT BY WEIGHT |
|---|---|---|---|
| 1 | Sodium Chloride | 30.0 | 18.30 |
| 2 | Sodium Hydroxide (granular) | 6.0 | 3.66 |
| 3 | Dextrin | 24.0 | 14.64 |
| | Mix fifteen (15) minutes to form a first mixture. | | |
| 4 | Sodium Carbonate (soda ash) | 15.0 | 9.15 |
| 5 | Sodium Chloride | 80.0 | 48.80 |
| 6 | Surfactant | 2.0 | 1.22 |
| 7 | Anti-deposition agent | 7.0 | 4.27 |
| | | 164.0 Pounds | |
| | Mix fifteen (15) minutes to form the solid cleaning agent. | | |

The above example shows the mixing of the sodium chloride and sodium hydroxide and dextrin to form a first mixture. Then, the first mixture was mixed with sodium carbonate, sodium chloride, surfactant, and an anti-deposition agent to form a solid cleaning agent.

One gram of the solid cleaning agent was mixed with 100 cc of water to have an aqueous solution with a pH of about 11.

Then, 100 grams of the solid cleaning agent was mixed with 20 gallons of water to form an aqueous cleaning solution having a pH of about 8. Twenty cc of the aqueous cleaning solution was poured into a 50 cc graduate and agitated by shaking 100 times. There resulted about 4 cc of foam in the 50 cc graduate.

Dishes, eating utensils and glassware were washed with the cleaning agent in an automatic dishwashing machine. The dishes and eating utensils were clean and the glassware was clear and free of spots.

EXAMPLE XII

| MIX | COMPONENT | WEIGHT (POUNDS) | PERCENT BY WEIGHT |
|---|---|---|---|
| 1 | Sodium Chloride | 40.00 | 25.80 |
| 2 | Sodium Hydroxide (granular) | 6.0 | 3.87 |
| 3 | Dextrin | 8.0 | 5.16 |
| | Mix fifteen (15) minutes to form a first mixture. | | |
| 4 | Sodium Carbonate (soda ash) | 15.0 | 9.68 |
| 5 | Sodium Chloride | 80.0 | 51.60 |
| 6 | Surfactant | 2.0 | 1.29 |
| 7 | Anti-deposition Agent | 4.0 | 2.58 |
| | | 155.0 Pounds | |
| | Mix fifteen (15) minutes to form the solid cleaning agent. | | |

The sodium chloride, sodium hydroxide and dextrin were mixed to form a first mixture. Then, the first mixture was mixed with the sodium carbonate, sodium chloride, surfactant and anti-deposition agent to form a solid cleaning agent.

One gram of the solid cleaning agent was mixed with 100 cc of water to form an aqueous solution with a pH of about 11.

Then, 100 grams of the solid cleaning agent was placed in 20 gallons of water to form an aqueous solution with a pH of about 7. Twenty cc of the aqueous cleaning solution was placed in a 50 cc graduate and agitated by shaking 100 times. There resulted 5 cc of foam in the 50 cc graduate.

Dishware, eating utensils and glassware were washed with the cleaning agent in an automatic dishwashing machine. The resulting dishware and eating utensils were clean. The glassware was clear and free of spots.

EXAMPLE XIII

| MIX | COMPONENT | WEIGHT (POUNDS) | PERCENT BY WEIGHT |
|---|---|---|---|
| 1 | Sodium Chloride | 40.0 | 23.80 |
| 2 | Sodium Hydroxide (granular) | 3.0 | 1.79 |
| 3 | Sodium Carbonate (soda ash) | 100.0 | 59.50 |
| 4 | Dextrin | 12.0 | 7.14 |
| | Mix ten (10) minutes to form a first mixture. | | |
| 5 | Surfactant | 4.0 | 2.38 |
| 6 | Anti-deposition Agent | 9.0 | 5.36 |
| | | 168.0 Pounds | |
| | Mix fifteen (15) minutes to form the solid cleaning agent. | | |

The sodium chloride, sodium hydroxide, and sodium carbonate and dextrin were mixed to form a first mixture. Then, a surfactant and an anti-deposition agent were mixed with the first mixture to form a solid cleaning agent.

One gram of the solid cleaning agent was placed in 100 cc of water to form an aqueous solution having a pH of about 11.

Then, 100 grams of the solid cleaning agent were placed in 20 gallons of water to form an aqueous cleaning solution with a pH of about 9. Twenty cc of the aqueous solution was placed in a 50 cc graduate and agitated by shaking 100 times. The result was 6 cc of foam in the 50 cc graduate.

The solid cleaning agent was placed in an automatic dishwashing machine with dishes, eating utensils, glassware and these items were washed. The dishes and eating utensils were cleaned. The glassware was clear and free of spots.

EXAMPLE XLV

| MIX | COMPONENT | WEIGHT (POUNDS) | PERCENT BY WEIGHT |
|---|---|---|---|
| 1 | Sodium Chloride | 20.0 | 12.30 |
| 2 | Sodium Hydroxide (granular) | 3.0 | 1.85 |
| 3 | Dextrin | 4.0 | 2.46 |
| 4 | Sodium Chloride | 80.0 | 49.20 |
| 5 | Surfactant | 1.5 | .92 |
| 6 | Anti-deposition agent | 4.0 | 2.46 |
| | Mix for fifteen (15) minutes to form a first mixture. | | |
| 7 | Sodium Carbonate | 50.0 | 30.75 |
| | | 162.5 Pounds | |
| | Mix for ten (10) minutes to form the solid cleaning agent. | | |

The sodium chloride, sodium hydroxide, dextrin, sodium chloride, surfactant and anti-deposition agent were mixed for fifteen minutes to form a first mixture. Then, the first mixture was mixed with sodium carbonate to form a solid cleaning agent. The solid cleaning agent was of such a size that a majority of it will pass through a 40 mesh screen and will not pass through a 60 mesh screen.

One gram of the solid cleaning agent was placed in 100 cc of water to form an aqueous solution having a pH of about 11.

Then 100 grams of the solid cleaning agent was mixed with 20 gallons of water to form an aqueous solution having a pH of 9. Twenty cc of this aqueous solution was placed in a 50 cc graduate and agitated by shaking 100 times. There was no foam in the graduate.

The solid cleaning agent with dirty dishes, eating utensils and glassware were placed in an automatic dishwasher and the items washed. The dishes and eating utensils were clean. The glassware was free of spots.

EXAMPLE XV

| MIX | COMPONENT | WEIGHT (POUNDS) | PERCENT BY WEIGHT |
|---|---|---|---|
| 1 | Sodium Hydroxide | 6.0 | 3.49 |
| 2 | Dextrin | 8.0 | 4.62 |
| 3 | Sodium Carbonate (soda ash) | 50.0 | 28.90 |
| 4 | Anti-deposition | 7.0 | 4.05 |
| | Mix for fifteen (15) minutes to form a first mixture. | | |
| 5 | Sodium Chloride | 100.0 | 57.80 |
| 6 | Surfactant | 2.0 | 1.16 |
| | | 173.0 Pounds | |
| | Mix for fifteen (15) minutes to form the solid cleaning agent. | | |

The sodium hydroxide, dextrin, sodium carbonate and anti-deposition agent were mixed to form a first mixture. Then, the first mixture was mixed with sodium chloride and surfactant to form the solid cleaning agent.

The solid cleaning agent was of such a size that the majority passed through a 40 mesh screen and would not pass through a 60 mesh screen.

One gram of the solid cleaning agent was placed in 100 cc of water to form an aqueous solution having a pH of about 11.

Then, 100 grams of the solid cleaning agent was placed in 20 gallons of water to form an aqueous cleaning solution having a pH of about 8.5. Twenty cc of the aqueous cleaning solution was placed in a 50 cc graduate and agitated by shaking 100 times. There was no foam in the 50 cc graduate.

The cleaning agent was placed in an automatic dishwasher with dirty dishes, eating utensils and glassware. Upon cleaning the eating utensils and dirty dishes were clean. The glassware was clean.

From the foregoing it is seen that the major components, sodium chloride, sodium carbonate, sodium hydroxide and dextrin are all readily commercially available chemicals.

The sodium of the sodium hydroxide and the dextrin react to form a complex. In an aqueous solution this complex forms sodium hydroxide which increases the pH of the aqueous solution. The chemical sodium hydroxide is not handled with bare hands as there is a possibility of burning the skin. The sodium hydroxide with the bare hands and with little liquid becomes slippery. However, with the formation of the complex of sodium and dextrin the complex can be handled with the bare hands and can be handled safely. Therefore, the sodium hydroxide and the dextrin are mixed together to form the complex which can be handled safely by an individual and with the individuals bare hands.

The sodium carbonate in an aqueous solution reacts to form a basic aqueous solution having high pH.

The sodium chloride is a neutral salt which is safe to handle and can be readily handled by an individual.

In all, the cleaning agent is safe to handle with the bare hands and can be placed in contact with the skin of an individual. An individual can feel and solid cleaning agent with the individuals bare hands without harm to the skin of the hands.

The cleaning agent comprises a small amount of surfactant to assist in the removal of food from tableware, eating utensils and glassware and also to assist in the removal of dirt impurities from cloth and fabric.

Also, the cleaning agent comprises an anti-deposition material to preclude the deposition of pollutants such as food, dirt and the like on the tableware, eating utensils and glasses and also fabric and cloth.

The cleaning agent is free of a bleaching agent as such.

The cleaning agent consists essentially of an alkali metal compound other than hydroxide and carbonate; and alkali metal hydroxide, and alkali metal carbonate; a compound of a halide; and, dextrin. The alkali metal compound other than hydroxide and carbonate and the compound of a halide can be the same such as sodium chloride or table salt. The alkali metal hydroxide can be sodium hydroxide. The alkali metal carbonate can be sodium carbonate. The sodium chloride can vary from about 23.8% by weight to approximately 77.4% by weight. The sodium hydroxide can vary from about 0.6% by weight to approximately 7.7% by weight. The sodium carbonate can vary from about 9.1% by weight to approximately 65% by weight. The dextrin can vary from about 2.4% by weight to approximately 14.7% by weight. The cleaning agent can be made by the method comprising mixing together and pulverizing together the alkali metal compound other than hydroxide and carbonate and said compound of a halide to form a first mixture. The dextrin and the alkali metal carbonate may be part of the first mixture. Then, there is mixed together and pulverized together the alkali metal compound other than hydroxide and carbonate, the alkali metal hydroxide and the compound of halide to form a first mixture. The dextrin in said alkali metal carbonate may be part of said first mixture. Then, there is mixed together and pulverized together the rest of the components of said cleaning agent with said first mixture to form said cleaning agent. In other words, the sodium chloride and the sodium hydroxide may be mixed together to form a first mixture. The dextrin and sodium carbonate may be part of said first mixture. Then, the rest of the components of said cleaning agent may be mixed together and pulverized together with said first mixture to form said cleaning agent. A process for cleaning a soiled article such as tabelware and dishware and glasses soiled with food and fabric and cloth soiled with dirt and the like may be cleaned by first preparing the cleaning agent. Then the cleaning agent is contacted with an aqueous medium to form a aqueous cleaning solution having a pH greater than about 9. The aqueous cleaning solution having a pH greater than about 9 and the soiled article are contacted together to clean the soiled article. It is well known that the activity of a chemical increases with an increase in temperature. Therefore, it is advisable to have the temperature of the aqueous cleaning solution the soiled article at a temperature above about 140° F.

From the foregoing you have seen that I have provided a cleaning agent which has a dual capacity in that it can be used in an automatic dishwashing machine for cleaning food from tabelware, eating utensils and glasses and can also be used for removing dirt and the like from cloth and fabric.

The cleaning agent is designed and formulated to prevent the deposition of a particulate on the subject matter which has been cleaned. For example, the cleaning agent prevents the deposition of food on tableware, eating utensils and glassware which has been cleaned This is particularly desirable with respect to glasses. Also, the cleaning agent prevents the deposition of dirt and the like on cloth and fabric which has just been cleaned. If the dirt and the like were allowed to redeposit on the cloth and fabric then the cloth and fabric would have a dull appearance instead of a clear appearance of clean cloth or clean fabric.

The cleaning agent is designed to provide a relatively high pH, at least above pH 9 and preferably in the range of 10 to 11. In certain instances it may be desirable to have the aqueous cleaning solution comprising the cleaning agent with pH above 11. However, the pH of the actual cleaning solution should be at least 9.

Another desirable feature of this cleaning agent is that it is free of a pollutant such as phosphorous and a compound of phosphorous. To repeat, there are many fine cleaning agents which are commercially available. These cleaning agents comprise a compound of phosphorous such as sodium triphosphate or other phosphorous compounds. Phosphorous is a pollutant and I have designed and invented this cleaning agent to be free of phosphorous and yet to have good and acceptable clean qualities.

Another feature of this cleaning agent is that it is inexpensive to manufacture and the manufacturing equipment is inexpensive. In fact, a piece of manufacturing equipment can be a cement mixer with balls or one inch pieces of pipe which are plugged at each end. The cement mixer and the one inch plugged piece of pipe are equivalent to a ball mill and after mixing for a suitable period of time or rotating for a suitable period of time the cleaning agent is mixed. As is well known a concrete mixer is inexpensive and is an inexpensive basis for a ball mill.

Another desirable feature of this cleaning agent is that a person can handle the cleaning agent with bare hands and contact with the skin does not produce serious and undesirable side effects on the person handling the cleaning agent.

The cleaning agent is made from readily available commercial materials such as sodium chloride, sodium carbonate, sodium hydroxide, dextrin and a small amount of a surfactant and a small amount of a anti-deposition agent. There are many sources of the readily available materials. Sodium chloride is commercially available from many sources. Sodium carbonate is also available from many sources. Likewise, sodium hydroxide is available from many sources. There are numerous commercially available surfactants and there are numerous commercially available anti-deposition agents.

In summary, this cleaning agent can be used for cleaning dishes, tableware and glassware in an automatic dishwashing machine and also can be used for cleaning cloth and fabric and clothes in an automatic washing machine. It is conceivable that the cleaning agent can be used for cleaning dishes, tableware and glassware by hand although it may be advisable to have plastic or rubber gloves. Likewise, the cleaning agent can be used in an aqueous solution for cleaning cloth and fabric and clothes by hand and again it is advisable to wear plastic or rubber gloves.

From the foregoing and having presented by invention what I claim is:

1. A cleaning agent consisting essentially of:

a. an alkali metal compound other than hydroxide and carbonate;

b. an alkali metal hydroxide;

c. an alkali metal carbonate;

d. a compound of a halide;

e. dextrin;

f. said alkali metal compound and said compound of a halide being sodium chloride;

g. said alkali metal hydroxide being sodium hydroxide; and, h. said alkali metal carbonate being sodium carbonate.

2. A cleaning agent according to claim 1 comprising:

j. said dextrin being in a complex with sodium.

3. A cleaning agent according to claim 2 comprising:

k. a small percentage by weight of a surfactant; and, l. a small percentage by weight of an anti-deposition agent.

4. A cleaning agent according to claim 1 comprising:

j. said sodium chloride varying from about 23.8% by weight to approximately 77.4% by weight;

k. said sodium hydroxide varying from about 0.6% by weight to approximately 7.7% by weight;

l. said sodium carbonate varying from about 9.1% by weight to approximately 65.0% by weight; and, m. said dextrin varying from about 2.4% by weight to approximately 14.7% by weight.

5. A cleaning agent according to claim 3 comprising:

m. said sodium chloride varying from about 23.8% by weight to approximately 77.4% by weight;

n. said sodium hydroxide varying from about 0.6% weight to approximately 7.7% by weight;

o. said sodium carbonate varying from about 9.1% by weight to approximately 65.0% by weight; and, p. said dextrin varying from about 2.4% by weight to approximately 14.7% by weight.

6. A method for making a cleaning agent consisting essentially of the following components:

a. an alkali metal compound other than hydroxide and carbonate;
b. an alkali metal hydroxide;
c. an alkali metal carbonate;
d. a compound of halide;
e. dextrin;

Said method comprising:

f. mixing together and pulverizing together said alkali metal compound, other than hydroxide and carbonate, said alkali metal hydroxide and said compound of a halide to form a first mixture;
g. said dextrin and said alkali metal carbonate may be part of said first mixture;
h. mixing together and pulverizing together the rest of said components of said cleaning agent and said first mixture to form said cleaning agent;
i. said alkali metal compound and said compound of a halide being sodium chloride;
j. said alkali metal hydroxide being sodium hydroxide; and,
k. said alkali metal carbonate being sodium carbonate.

7. A method for making a cleaning agent according to claim 6 comprising:

m. said dextrin being in a complex with sodium.

8. A method for making a cleaning agent according to claim 7 comprising:

n. mixing together and pulverizing together with the aforementioned components of said cleaning agent a small percentage by weight of a surfactant and a small percentage by weight of an anti-deposition agent.

9. A method for making a cleaning agent according to claim 6 comprising:

m. said sodium chloride varying from about 23.8% by weight to approximately 77.4% by weight;
n. said sodium hydroxide varying from about 0.6% by weight to approximately 7.7% by weight;
o. said sodium carbonate varying from about 9.1% by weight to approximately 65.0% by weight; and,
p. said dextrin varying from about 2.4% by weight to approximately 14.7% by weight.

10. A method for making a cleaning agent according to claim 8 comprising:

o. said sodium chloride varying from about 23.8% by weight to approximately 77.4% by weight;
p. said sodium hydroxide varying from about 0.6% by weight to approximately 7.7% by weight;
q. said sodium carbonate varying from about 9.1% by weight to approximately 65.0% by weight; and,
r. said dextrin varying from about 2.4% by weight to approximately 14.7% by weight.

11. A cleaning agent consisting essentially of the following components:

a. an alkali metal halide;
b. an alkali metal hydroxide;
c. an alkali metal carbonate; and,
d. dextrin.

12. A cleaning agent according to claim 11 comprising:

i. said alkali metal halide being sodium chloride;
j. said alkali metal hydroxide being sodium hydroxide; and,
k. said alkali metal carbonate being sodium carbonate.

13. A cleaning agent according to claim 11 comprising:

i. said dextrin being in a complex with an alkali metal.

14. A cleaning agent according to claim 12 comprising:

m. said dextrin being in complex with sodium.

15. A cleaning agent according to claim 14 comprising:

n. a small percentage by weight of a surfactant; and,
o. a small percentage by weight of an anti-deposition agent.

16. A cleaning agent according to claim 12 comprising:

m. said sodium chloride varying from about 23.8% by weight to approximately 77.4% by weight;
n. said sodium hydroxide varying from about 0.6% by weight to approximately 7.7% by weight;
o. said sodium carbonate varying from about 9.1% by weight to approximately 65.0% by weight; and,
p. said dextrin varying from about 2.4% by weight to approximately 14.7% by weight.

17. A cleaning agent according to claim 15 comprising:

o. said sodium chloride varying from about 23.8% by weight to approximately 77.4% by weight;
p. said sodium hydroxide varying from about 0.6% by weight to approximately 7.7% by weight;
q. said sodium carbonate varying from about 9.1% by weight to approximately 65.0% by weight; and,
r. said dextrin varying from about 2.4% by weight to approximately 14.7% by weight.

18. A process for cleaning a soiled article, said process comprising:

preparing a cleaning agent consisting essentially of:

a. an alkali metal compound other than hydroxide and carbonate;
b. an alkali metal hydroxide;
c. an alkali metal carbonate;
d. a compound of a halide;
e. dextrin;
f. contacting said cleaning agent with an aqueous medium to form an aqueous cleaning solution having a pH greater than about 9;
g. mixing together said soiled article with said aqueous cleaning solution to clean said soiled article;
h. said alkali metal compound and said compound of a halide being sodium chloride;
i. said alkali metal hydroxide being sodium hydroxide; and,
j. said alkali metal carbonate being sodium carbonate.

19. A process for cleaning a soiled article according to claim 18 comprising:

l. said dextrin being in complex with sodium.

20. A process for cleaning a soiled article according to claim 19 comprising:

m. a small percentage by weight of a surfactant; and,
n. a small percentage by weight of an anti-deposition agent.

21. A process for cleaning a soiled article according to claim 18 comprising:

l. said sodium chloride varying from about 23.8% by weight to approximately 77.4% by weight;
m. said sodium hydroxide varying from about 0.6% by weight to approximately 7.7% by weight;
n. said sodium carbonate varying from about 9.1% by weight to approximately 65.0% by weight; and,
o. said dextrin varying from about 2.4% by weight to approximately 14.7% by weight.

22. A process for cleaning a soiled article according to claim 20 comprising:

o. said sodium chloride varying from about 23.8% by weight to approximately 77.4% by weight;
p. said sodium hydroxide varying from about 0.6% by weight to approximately 7.7% by weight;
q. said sodium carbonate varying from about 9.1% by weight to approximately 65.0% by weight; and,
r. said dextrin varying from about 2.4% by weight to approximately 14.7% by weight.

* * * * *